US008640623B2

(12) United States Patent
Eckstein

(10) Patent No.: US 8,640,623 B2
(45) Date of Patent: Feb. 4, 2014

(54) MULTIPLE PURPOSE TANDEM NESTED PROJECTILE

(76) Inventor: Donald B. Eckstein, Burke, VA (US)

( * ) Notice: Subject to any disclaimer, the term of this patent is extended or adjusted under 35 U.S.C. 154(b) by 0 days.

(21) Appl. No.: 13/298,676

(22) Filed: Nov. 17, 2011

(65) Prior Publication Data

US 2012/0266773 A1 Oct. 25, 2012

Related U.S. Application Data

(60) Provisional application No. 61/478,118, filed on Apr. 22, 2011.

(51) Int. Cl.

| | |
|---|---|
| ***F42B 12/04*** | (2006.01) |
| ***F42B 12/06*** | (2006.01) |
| ***F42B 12/24*** | (2006.01) |

(52) U.S. Cl.

USPC ..... 102/506; 102/439; 102/438; 102/517; 102/518

(58) Field of Classification Search

USPC ..... 102/506, 517, 518, 438, 439, 377, 378, 102/703, 501

See application file for complete search history.

(56) References Cited

U.S. PATENT DOCUMENTS

| | | | | |
|---|---|---|---|---|
| 3,450,050 | A * | 6/1969 | Robinson | 102/506 |
| 3,680,485 | A * | 8/1972 | Zaid et al. | 102/506 |
| 3,802,345 | A * | 4/1974 | La Costa | 42/78 |
| 3,862,600 | A * | 1/1975 | Tocco | 102/438 |
| 4,777,882 | A * | 10/1988 | Dieval | 102/489 |
| 4,922,826 | A * | 5/1990 | Busch et al. | 102/489 |
| 5,796,031 | A * | 8/1998 | Sigler | 102/520 |
| 7,806,053 | B1 * | 10/2010 | King et al. | 102/517 |
| 8,191,478 | B2 * | 6/2012 | Herbage et al. | 102/352 |
| 8,250,987 | B1 * | 8/2012 | Morley et al. | 102/506 |
| 2012/0234198 | A1 * | 9/2012 | Carmel | 102/438 |

* cited by examiner

*Primary Examiner* — James Bergin

(74) *Attorney, Agent, or Firm* — Robert M. Downey, P.A.

(57) ABSTRACT

A multiple-purpose projectile assembly includes an anti-personnel projectile, an armor-penetrating projectile, a propellant, a base bleed gas, and a primer. The anti-personnel projectile includes a cavity having a scored surface and is made out of a soft metal. The armor-penetrating projectile is made from a hard metal and is housed partially within the cavity of the anti-personnel projectile prior to firing from a weapon. The propellant and the primer are both housed within the cavity. The firing of the projectile assembly causes the armor-penetrating projectile to drive into the primer, thereby detonating the primer, causing the detonation of the propellant, thereby increasing the pressure of the cavity and causing the two projectiles to separate after the projectile assembly leaves the bore of the weapon. The burning of the propellant releases a base bleed gas that reduces the drag experienced by the anti-personnel projectile.

18 Claims, 4 Drawing Sheets

MULTIPLE PURPOSE TANDEM NESTED PROJECTILE

This non-provisional patent application is based on provisional patent application Ser. No. 61/478,118 filed on Apr. 22, 2011.

BACKGROUND

History of Modern Assault Rifle Development

When WWII started, the standard U.S. Army infantry rifle was the M1 Garrand, which used the 30-06 cartridge. (The 30-06 cartridge notation breaks into the 30 being the caliber and 1906 the year it was adopted; using the modern ammunition notation system the projectile diameter is 7.62 mm and the cartridge length is 63 mm, or 7.62 mm×63 mm). This was the world's first semi-automatic infantry weapon to enter mass production and be issued to front line troops. While this is a very powerful cartridge effective at ranges of up to 1,000 meters, the size of this cartridge restricted the number of rounds loaded to only eight in the M1's en bloc ammunition clip system. (The en bloc clip was state of the art in the 1930s and was used to load the M1's internal magazine, but became obsolete with the modern external magazine system adopted by later assault rifles, which allow the storage of 20-30 rounds in magazines that could be easily topped off and replaced).

During WWII, the standard German Army bolt action Mouser 98 infantry rifle used a 7.92 mm×57 mm round (also known as the 8 mm×57 mm in Europe or 8 mm Mauser) with qualities and performance similar to that of the U.S. 30-06 cartridge. However, German analysis of how their infantry weapons were actually used in combat indicated that most engagements were at ranges of less than 400 meters and often required high rates of fire, so having a large, powerful cartridge that was effective to 800-1,000 meters was a waste of scarce materials (cartridge brass and gunpowder) and logistic resources. They designed a smaller, lighter, semi and automatic assault weapon designated StG-44 (Sturmgewehror or storm rifle 44) which used a shortened version of the 7.92 mm round already in production, designated 7.92 mm×33 mm Kurtz (German for short), stored in a detachable 30 round magazine.

After WWII, Russian designer Mikhail Kalashnikov continued to build on the StG-44 concept when he designed the AK-47 (automatic Kalashnikov 1947). Russia used (and continues to use today) a 7.62 mm×54 mm round for their machine guns and sniper rifles. The AK-47 uses a shortened version of the 7.62 mm×54 mm round designated 7.62 mm×39 mm, which allows 30 rounds to be carried in the standard, curved AK-47 magazine. Like the German StG-44 design, the 7.62 mm×39 mm round is designed to be effective at shorter ranges, with the reduced size and weight facilitating the supply of the large number of cartridges needed for high volume fire.

In contrast, after WWII the U.S. Army adopted the more traditional M-14, which used a modern 20 round external magazine to facilitate rapid reloading, and the shorter 7.62 mm×51 mm round, which became the standard NATO assault rifle, sniper rifle, and machine gun round. This weapon was employed in the Korean conflict, and the early years of Vietnam. But the M-14 was a larger, heavy weapon with only 20 rounds available in the standard external magazine, so the U.S. Army started to consider other assault weapon designs that were smaller, lighter, had less recoil, and carried more rounds of ammunition.

One weapon that stood out in the early 1960's was Eugene Stoner's AR-15, which was originally designed for the U.S. Air Force. It employed a 5.56 mm×45 mm cartridge, which allowed 30 rounds to be carried in the standard external magazine. This weapon was much lighter than the M-14 with reduced recoil, and the high velocity 5.56 mm round had similar effectiveness at shorter ranges (less than 400 m). Another design, the M-16, developed a bad reputation in the 1960s when the Army decided to substitute one type of gunpowder for another, which caused excessive fouling and residue in the weapon and resultant malfunctions. Another Army management and training miscue was promotion of the belief that M-16s did not require regular cleaning, so cleaning kits and instruction were not supplied to front line troops. Once these management and training deficiencies were rectified, the M-16 performed as designed, and regained its reputation as an accurate, easy to use, and effective assault rifle at less than 400 meters.

The newest version of the M-16 is the M-4. It is a carbine with a shorter barrel and collapsible stock, allowing easier handling in urban situations. The original triangular barrel heat shield has been replaced with either a round cover, or more commonly, metal rails that allow the easy installation of accessories like bipods, grenade launchers, etc. New sights, like the Trijicon Advanced Combat Optical Group (ACOG) allow fast, precise aiming even in low light conditions. However, the shorter 14.5 in barrel also reduced muzzle velocities and potential ammunition effectiveness.

Current Assault Rifle Ammunition Caliber, a Compromise:

The U.S. Army, and then NATO, converted their assault rifles from 7.62 mm×51 mm to 5.56 mm×45 mm ammunition because they could double the number of rounds sent downrange for roughly the same given volume, weight, and cost. The smaller size and mass of the 5.56 mm projectile (62 grains for the NATO standard M855/SS109 round) is less than half that of the standard 7.62 mm NATO round (147 grains for the M80 ball, 151 grains for the M61 armor piercing), but in theory the higher velocity maintains the desired energy level at combat ranges of less than 400 m. However, the shorter barrel of the M4 lowers the bullet velocity and potential yawing, which is a major factor in this rounds potential effectiveness. There have also been reports that M855 effectiveness is reduced when impacting the thin, low body mass combatants found in Africa and Afghanistan.

However, the future development potential of 5.56 mm×45 ammunition is limited because materials science and design cannot overcome simple physics, as the following Wikipedia chart illustrates:

Comparison of 5.56 Mm Versus 7.62 Mm NATO:

| Cartridge | Cartridge size | Cartridge weight | Bullet weight | Velocity | Energy |
|---|---|---|---|---|---|
| 5.56 mm NATO | 5.56 × 45 mm | 12.31 g (190 gr) - M855 Ball | 3.58(55 gr.)-4.02 g (62 gr.) | 905.85-945.5 m/s (2970-3100 ft/s)(62 gr.) | 1,072-1,797 J |
| 7.62 mm NATO | 7.62 × 51 mm | 25.4 g (392 gr) - M80 Ball | 9.33 g (147 grains) | 838 m/s (2749 ft/s) | 3,275 J |

Proposed 6.8 mm Remington Special Purpose Cartridge (SPC) Round:

The advantages of the M855/SS109 5.56 mm×45 mm round over the M80 7.62 mm×51 mm round (twice as many rounds per a given volume and weight, similar effectiveness in ranges less than 400 m when fired from long barreled weapons) are well known, as are the potential 5.56 mm development limitations (trend toward short barreled carbines which lowers muzzle velocities, lower body mass combatants in Africa and Afghanistan decreases wounding effectiveness, and longer engagement ranges).

One effectiveness solution gaining in popularity is a new cartridge, the 6.8 mm×43 mm Remington SPC. The 6.8 mm×43 mm round can fit in standard magazine wells of M-16 type weapons in widespread service. Converting existing 5.56 mm weapons to the 6.8 mm SPC only requires the replacement of the barrel, bolt, and magazines of 5.56 mm chambered weapons. According to Wikipedia, this round delivers 44 percent more energy than the 5.56 mm round in the key 100-300 m range. It also maintains a ballistic performance similar to the NATO 7.62 mm round and superior to the 5.56 mm and Russian 7.62 mm×39 mm rounds out to 400 m:

Modern Assault Rifle Design Examples:

Due to the continuing discussions of assault rifle cartridge tradeoffs, several manufactures have started manufacturing their latest designs in both 5.56 mm and 7.62 mm, with trials of 6.8 mm SPC weapons continuing. Hecker & Koch are offering two production versions of their latest design, the HK 416 (5.56 mm), the developmental HK 416 6.8 mm SPC (6.8 mm), and HK 417. The 5.56 mm and 6.8 mm SPC models can use the same receiver and magazine, while the HK417 must use a different receiver and magazine.

Assault Rifle Ammunition Velocity and Energy Tradeoffs:

In addition to the volume, weight, and number of available round tradeoffs mentioned earlier in the 5.56 mm and NATO 7.62 mm comparisons, there are also velocity, energy, and ballistic trajectory implications to choosing one round vice another. As shown in the below chart, probably the biggest disadvantage to the AK-47 7.62 mm×39 mm cartridge is the velocity and bullet drop at the 400 yard/meter distance as compared to the Western 5.56 mm, 6.8 mmSPC, and 7.62 mm NATO rounds. This is the major reason the Russian 7.62 mm×39 mm round was never adopted by Western militaries.

| Cartridge | Muzzle velocity | 200 yards drop | 200 yards velocity | 400 yards drop | 400 yards velocity |
|---|---|---|---|---|---|
| .223 55 gr M193 | 3,073 ft/s (937 m/s) | 2.2 inches | 2,353 ft/s (717 m/s) | 27.8 inches | 1,743 ft/s (531 m/s) |
| .223 77 gr OTM | 2,679 ft/s (817 m/s) | 3.3 inches | 2,216 ft/s (675 m/s) | 32.7 inches | 1,810 ft/s (550 m/s) |
| 6.8 SPC 115 gr SMK | 2,650 ft/s (810 m/s) | 3.5 inches | 2,143 ft/s (653 m/s) | 35.4 inches | 1,677 ft/s (511 m/s) |
| 6.8 SPC 110 gr V-MAX | 2,650 ft/s (810 m/s) | 3.3 inches | 2,208 ft/s (673 m/s) | 31.1 inches | 1,811 ft/s (552 m/s) |
| 7.62 × 39 mm | 2,300 ft/s (700 m/s) | 3.3 inches | 1,787 ft/s (545 m/s) | 53.8 inches | 1,324 ft/s (404 m/s) |
| .308 168 gr SMK | 2,600 ft/s (790 m/s) | 3.4 inches | 2,235 ft/s (681 m/s) | 32.3 inches | 1,891 ft/s (576 m/s) |

While the 6.8 mm SPC has many advantages over the current 5.56 mm/M855 cartridge, it is currently a non-standard developmental round which has not been approved for NATO service, which has standardized on the 5.56 mm×45 mm and 7.62 mm×51 mm rounds for logistic support reasons. Replacing the existing barrels, bolts, and magazines of existing 5.56 mm weapons is also not a trivial expense, nor is buying new weapons to replace millions of existing assault rifles. While discussions on how to improve modern assault rifle design has been focused on cartridge types, there are other potential approaches that can leverage existing investments by improving 7.62 mm×51 mm ammunition design.

The Duplex Load:

Another approach to maximizing the assault rifle ammunition effectiveness is to have two projectiles fired from the same cartridge, which has been termed a duplex load or cartridge. According to the Gun Zone (http://www.thegunzone.com/salvo.html), research on duplex or salvo loads go back a couple of decades:

5.56×45 mm/5.56 NATO:

In November of 1962, Frankford Arsenal loaded a small quantity of 0.223 Duplex cartridges. This consisted of a forward bullet of 33 grains followed by a second 34 grain projectile. The velocity is quoted as 2,760 fps. During the late '60s, Frankford Arsenal experimented with the Low Noise Duplex Cartridge (LNDC). The earliest cartridges were loaded with a pair of 110 grain tungsten core slugs. The initial projectiles use a blunt round nose profile, but later efforts consist of a semi-spitzer shape.

During the late 1980s, Olin produced three different types of duplex 5.56×45 mm ammo for Colt's entry in the Advanced Combat Rifle (ACR) trials. The original version used a special long-neck case which held a saboted pair of tungsten sub-projectiles. An interim version switched back to the standard length case firing a saboted pair of 27 grain 0.158" tungsten sub-projectiles. The final version used the standard case with a pair of 0.224" projectiles weighing 35 grains (front) and 33 grains (rear), giving a velocity of ~2,900 fps. The Bodermansports.com website claims to have some of the ACR test ammo available. Reportedly, during Operation Desert Shield, the USMC approached Olin about making a production run of the full-bore 5.56 mm duplex ammo. Olin declined.

According to the Gun Zone, similar initiatives have also been taken for 7.62 mm×51 mm cartridges:

7.62 mm NATO:

"Project SALVO"—An early duplex 7.62×51 mm cartridge used a pair of 96 grain projectiles (2,560 fps) in a long necked case. However, the later T314E3 duplex load used a standard case. This was eventually type-classified as the M198 Duplex Ball, and is credited with two ~84 grain slugs at 2,750 fps.

The NATO 7.62 mm M198 Duplex Ball round with two similar 84 grain bullets failed to gain acceptance, evidently due to poor accuracy. The two bullets/projectiles had similar weights and shapes, but evidently the dispersion as the range increased was deemed unsatisfactory. At short range, dispersion increases hit probability, but at long range excessive dispersion lowers it. Ideally, if dispersion could be controlled so that both projectiles dispersed only 10-20 mm per hundred meters of flight, then a 7.62 mm duplex cartridge with projectiles equal to or greater than the 62 grain M855 could offer the best of both calibers—greater penetration, effectiveness, and range than 5.56 mm rounds like the M855, but with same volumetric efficiency (e.g., number of projectiles downrange per a given weight and volume).

Bullet Design Compromise: Soft vs. Hard Target Penetration

One of the major challenges of modern assault rifle and machine gun bullet design is the need to be effective against both soft and hard targets—simultaneously. Traditional soft target bullet design emphasizes expansion after target impact. For example, most modern rifle rounds for shooting animals typically have a soft lead core with a copper jacket. (Lead is a soft metal that will foul or leave deposits in gun barrel rifling groves used to impart spin to a projectile for increased accuracy—the copper jacket minimizes these deposits). Upon impacting animal tissue, the soft lead core expands, so that the size of the projectile typically increases in diameter to twice that (or more) of the original caliber. This design gives the expanded bullet a mushroom appearance, and increases the wound channel size and energy transfer to the target. Some modern bullet designs (like the M855) increase the size of the wound channel by yawing after impact. However, in the case of the M855, this characteristic is highly dependent upon velocity. Once velocity falls below a certain level, due to using a short-barreled carbine, or velocity bleed (due to air resistance) at extended ranges (as noted in previous citations). Some modern bullet designs (like the M855) are also deliberately designed so that cannelure (a groove around the cylinder of a bullet) will increase the tendency of the projectile to fragment as it yaws, which is another way of increasing the wound channel, and energy transfer. However, if the lower velocity (M855) projectile does not yaw, then cannelure design and placement will not increase fragmentation.

Penetrating and defeating hard targets requires a diametrically opposite projectile design philosophy. Projectile expansion is to be avoided at all costs, because it will limit penetration. This is done by using hard metals (steel, tungsten, depleted uranium, etc.) for the penetrator. Small projectile diameters are better than larger ones because the reduced frontal area will concentrate all of the projectile energy (projectile mass times velocity) on a smaller area, increasing penetration. This design approach is taken to the logical extreme for Hyper Velocity Armor Piercing Fin Stabilized Discarding Sabot (HVAPFSDS) tank rounds. These projectiles look like darts, with very high length to diameter ratios.

The normal or preferred way to address both of these requirements is to develop a separate projectile or cartridge for each requirement. Unfortunately, this means carrying two different type rounds in the field, and changing magazines prior to engaging the different targets. And due to modern body armor (Kevlar vests fitted with ceramic plate like the Small Arms Protective Inserts), which can stop some types of 5.56 mm and 7.62 mm ammunition, you might actually need to use both of the soft and hard target defeat options at the same time to defeat the enemy combatant.

In light of the shortcomings and limitations of the current 5.56 mm, 6.8 mm, and 7.62 mm cartridges, there is a desperate need for a more effective form of ammunition that can combine anti-personnel and anti-armor effects into a single round without the need to switch between two types of ammunition or to slow down the rate of firing.

SUMMARY

The terms "MPTNP" and "DPTNP" as used herein refer to some embodiments of the claims. "MPTNP" stands for "Multiple-Purpose Tandem Nested Projectile" and "DPTNP" stands for "Dual-Purpose Tandem Nested Projectile." Both of these terms are interchangeable with one another and no limitations should be construed when either of the terms is used instead of the other. Particularly, the use of the terms "DPTNP" or "Dual-Purpose Tandem Nested Projectile" may be used to describe a "MPTNP" or "Multiple-Purpose Tandem Nested Projectile" and therefore the use of the terms "DPTNP" or "Dual-Purpose Tandem Nested Projectile" should not be taken to mean that only two purposes may be fulfilled by the projectile, instead that multiple and many purposes may be fulfilled by the projectile.

Some embodiments of the claims will meet the needs described at the end of the background section and may include a multiple-purpose projectile assembly capable of being projected comprising an outer member and an inner member. The outer member defines a first projectile and has at least one communicating portion, and the inner member defines a second projectile. The inner member is located adjacent to the communicating portion of the outer member prior to the projection of either projectile. The projecting of either of the outer member or the inner member causes the projecting of the other of the outer member or the inner member.

Some Advantages of Some Embodiments

Some of the advantages that may be provided by some embodiments are detailed below. Other advantages may additionally be provided by some embodiments and are envisioned to be provided under the scope of the attached claims.

Current 7.62 mm rounds have a weight and volume approximately twice that of current 5.56 mm rounds; doubling the number of 7.62 mm projectiles per cartridge negates one of the primary reasons 5.56 mm rounds were adopted. However, the 7.62 mm DPTNP design of some embodiments does not just double the number of projectiles—it allows each of the two projectiles to be optimized for their specific soft and hard target defeat functions. This means that one 7.62 mm DPTNP round is not just equivalent to two 5.56 mm rounds; it means that each of the 7.62 mm projectiles could be significantly more effective than two standard 5.56 mm projectiles. While 7.62 mm cartridges are roughly twice as expensive as 5.56 mm cartridges, a 7.62 mm DPTNP round may only be about 10 percent (cost of the extra internal primer and base bleed propellant) more expensive to manufacture, and may not require any special handing, or modifications to 7.62 mm weapons.

All assault rifles and machine guns have a cyclic rate of fire—so many rounds per minute, usually 500-600. Rifles and machine guns armed with DPTNP rounds may have approximately twice the effective rate of fire, without any weapons modifications, since each round fired is actually launching multiple projectiles instead of only one. Since continuous firing generates a lot of heat, most training programs stress the need to fire in bursts of several rounds at a time. Some assault rifles have a burst fire position on the safety switch, with three rounds being typical. When loaded with the DPTNP round, a single shot sends at least two projectiles downrange, at least doubling the rate of fire; a "double tap" would therefore send at least four projectiles downrange, at least two designed for soft targets, and at least two for hard targets. Another way to look at the DPTNP advantage is that an M-4 normally has a 30 round magazine, while an equivalent 7.62 mm assault rifle has a 20 round magazine. However, the 20 round 7.62 mm equipped with DPTNPs of some embodiments will send at least 40 projectiles downrange—at least a thirty-three percent increase over the M-4 using standard projectiles. In addition, assault rifle and machine guns are generally rated to fire a specific number of rounds before their barrels are replaced; this same observation applies to the entire weapon. With a DPTNP round, the weapon is subjected to the normal wear and tear of single round ammunition but at least twice as many rounds go downrange, significantly reducing long term logistic costs.

These and other features, aspects and advantages of some embodiments are more readily apparent with reference to the detailed description and accompanying drawings.

BRIEF DESCRIPTION OF THE DRAWINGS

For a fuller understanding of the nature of some embodiments, reference should be made to the following detailed description taken in conjunction with the accompanying drawings in which.

Like reference numerals refer to like parts throughout the several views of the drawings.

DETAILED DESCRIPTION OF SOME EMBODIMENTS

Unless otherwise defined, all terms, and especially any technical and/or scientific terms, used herein may be taken to have the same meaning as commonly understood by one having an ordinary skill in the art.

Reference is made herein to some "embodiments." It should be understood that an embodiment is an example of a possible implementation of any features and/or elements presented in the attached claims. Some embodiments have been described for the purpose of illuminating one or more of the potential ways in which the specific features and/or elements of the attached claims fulfill the requirements of uniqueness, utility and non-obviousness.

Unless otherwise specified, one or more particular features and/or elements described in connection with one or more embodiments may be found in one embodiment, or may be found in more than one embodiment, or may be found in all embodiments, or may be found in no embodiments.

Any and all details set forth herein are used in the context of some embodiments and therefore should NOT be necessarily taken as limiting factors to the attached claims. Any descriptions of elements and/or features and/or the materials used to create those elements or features, or examples or methods included in the descriptions of the various embodiments are nonlimiting and are given as an illustration only. Accordingly, the embodiments can be manufactured, distributed, used, practiced, and carried out in numerous ways.

The attached claims and their legal equivalents can be realized in the context of embodiments other than the ones used as illustrative examples in the description herein.

Referring to the several views of the drawings, the multiple-purpose projectile assembly is shown in accordance with at least one embodiment of the invention. In each of the several views, the projectile assembly is generally indicated as 10.

Figure 1:
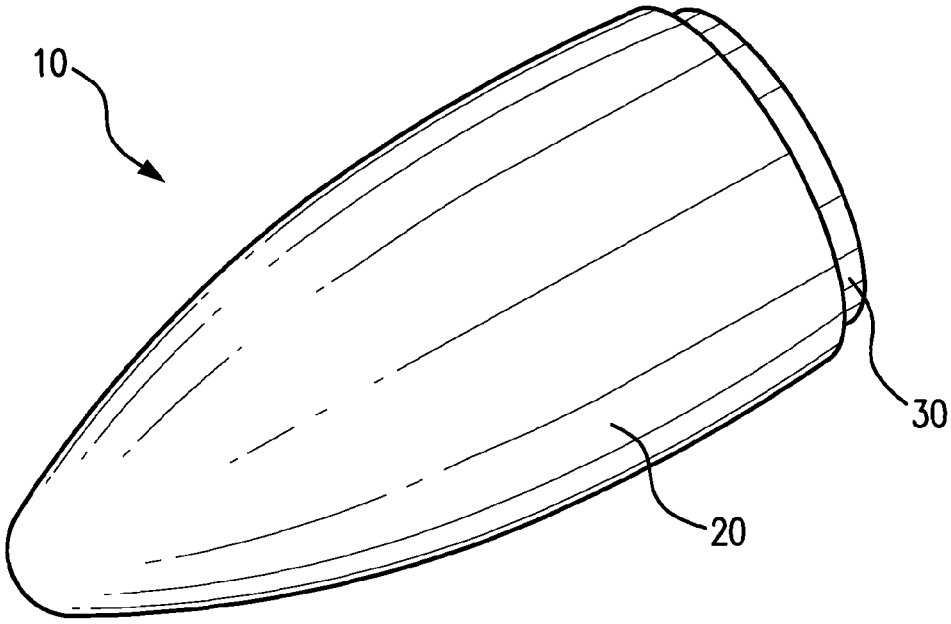
FIG. 1 is a schematic perspective view of the first projectile according to an embodiment.

Reference is now made to FIG. 1. The multiple-purpose projectile assembly 10 is shown in perspective and includes an outer member 20 and an inner member 30. The outer member 20 defines a first projectile 20, and the terms "outer member 20" and "first projectile 20" are interchangeable herein. The inner member 30 defines a second projectile 30, and the terms "inner member 30" and "second projectile 30" are interchangeable herein. Both the first projectile 20 and the second projectile 30 are fired or projected in conjunction, such that one of the first projectile 20 or the second projectile 30 cannot be fired or projected without also firing or projecting the other of the first projectile 20 or the second projectile 30.

Figure 2:
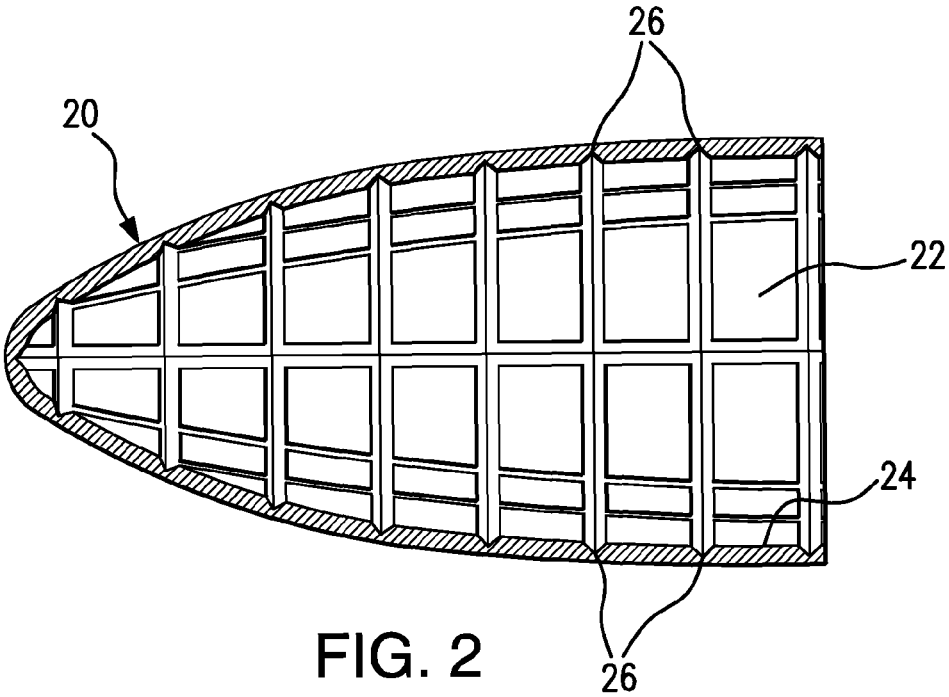
FIG. 2 is a schematic side sectional view of the first projectile according to an embodiment wherein the inner scored surface of the cavity is shown.

Additional reference is now made to FIG. 2. The first projectile 20 is shown in elevated cross-section and includes a communicating portion 22. In one or more embodiments, the communicating portion 22 may be a cavity 22, as shown in the drawings. The terms "communicating portion" and "cavity" are interchangeable herein, and the implications of the term "cavity" do not limit the scope of the term "communicating portion" in any way, as a "cavity" is only shown to illustrate a possible example in a possible embodiment having a communicating portion. The first projectile 20 may include a scored surface 24 having scores 26 and may further, in some embodiments, define an anti-personnel projectile 20. Scores 26 create areas of weakness in the projectile 20 such that, when the projectile 20 is projected and subsequently impacts on a target, the force of impact will cause the projectile 20 to shatter along the scores 26. In this manner, the likelihood of the "fragmentation" of the anti-personnel projectile 20 is increased. Fragmentation of the projectile 20 causes the projectile 20 to be particularly suited for damaging soft targets, such as human flesh. Upon impact with a soft target, the projectile 20 is shattered into multiple fragments that spread throughout the target thereby causing more damage than a single, non-fragmenting projectile would be capable of. In some embodiments, the anti-personnel projectile may be made from a soft metal, such as copper and/or lead etc. in order to increase the capability of the projectile to deform and to promote expansion of the projectile 20 upon impact with a target. Expansion of the projectile 20 increases the size of the impact on a target, and increases the energy transfer to the target thereby causing more damage to the target.

Figure 3:
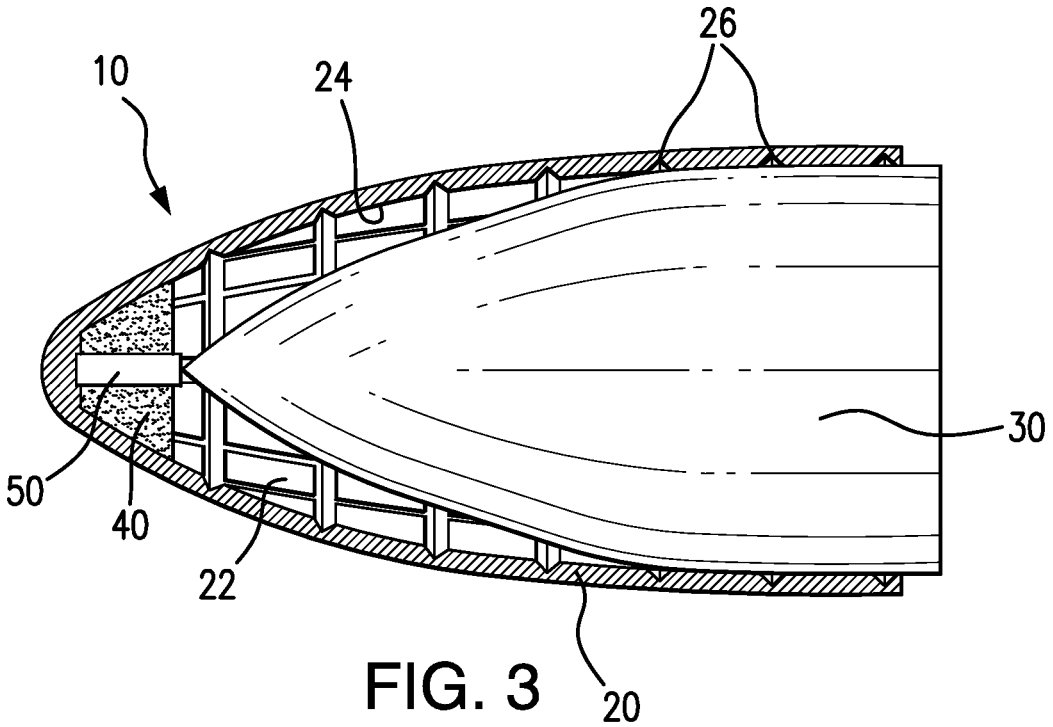
FIG. 3 is a schematic side sectional view of the multiple-purpose projectile assembly according to an embodiment, including the first and second projectiles, the propellant, and the primer.

Additional reference is now made to FIG. 3. The projectile assembly 10 is shown in elevational cross-section prior to projection and includes the first projectile 20, the second projectile 30, a propellant 40, and a primer 50.

Reference is still made to FIG. 3 and in particular to the second projectile 30 of FIG. 3. The inner member or second projectile 30 is located adjacent to the communicating portion 22 prior to projection of the projectile assembly 10. In the embodiment shown in the figure, the communicating portion 22 is a cavity 22, wherein the second projectile 30 is located partially within the cavity 22. The second projectile 30 may define an armor-penetrating projectile 30. The armor-penetrating projectile 30 has a narrow, elongate shape in order to reduce the frontal area that will apply force to a target thereby increasing the chance of penetration. The diameter of the armor-penetrating projectile 30 is smaller than the diameter of the anti-personnel projectile 20. In some embodiments, the armor-penetrating projectile 30 may be made from hard metals, such as steel, tungsten, depleted uranium, etc. in order to help strengthen the projectile 30 and prevent the projectile 30 from deforming or expanding upon impact with a target.

Reference is still made to FIG. 3 and in particular to the propellant 40 of FIG. 3. The propellant 40 is an explosive that is capable of being detonated. In some embodiments, the propellant 40 may be an explosive that is very powerful and having a low sensitivity thereby requiring a high amount of energy to detonate. The propellant 40 may be referred to as the "secondary explosive" of the multiple-purpose projectile assembly 10. As shown in FIG. 3, the propellant 40 is located adjacent to both of the outer member 20 and the inner member 30, particularly it is located adjacent to the communicating portion 22 of the outer member 20, and even more particularly it is located within the cavity 22 of the outer member 20 in some embodiments. The propellant 40 is also located adjacent to the primer 50. When the propellant 40 is detonated, it pressurizes the space of the cavity 22 between the outer member 20 and the inner member 30. This pressurization applies a large force to both of the outer member 20 (in the forward direction of projectile motion) and the inner member 30 (in the reverse direction of projectile motion) thereby causing the inner member 30 to withdraw from the communicating portion 22 and thereby causing an increased separation between the first projectile 20 and the second projectile 30.

Reference is still made to FIG. 3 and in particular to the primer 50 of FIG. 3. The primer 50 is an explosive that is capable of being detonated. In some embodiments, the primer 50 may be an explosive that is relatively weak in strength and that is extremely sensitive thereby requiring very little energy to detonate. The primer 50 may be referred to as the "primary explosive" of the multiple-purpose projectile assembly 10. In particular, some embodiments may have a primer 50 that is significantly more sensitive and less powerful than the propellant 40. The use of a primer 50 and a propellant 40 in combination provides an advantage, namely that the primary explosive (i.e. the propellant 40) may be an explosive formulated to be stable and safe to handle to reduce the likelihood that it will explode prematurely. Stable explosives such as the propellant 40 may be difficult to intentionally detonate, which is why the primer 50 is used. The primer 50 may be very unstable; however it may also not be very powerful. As shown in FIG. 3, the primer 50 is located adjacent to both of the outer member 20 and the inner member 30, particularly it is located adjacent to the communicating portion 22 of the outer member 20, and even more particularly it is located within the cavity 22 of the outer member 20 in some embodiments. The primer 50 is also located adjacent to the propellant 40. The primer 50 is intended to detonate when the second projectile 30 inserts into and penetrates the primer 50, which occurs when the projectile assembly 10 is projected from a weapon. More specifically, in some embodiments, the firing of the projectile assembly 10 from a firearm causes the second projectile 30 to move forward, further into the cavity 22 of the first projectile 20. By moving forward, the second projectile 30 penetrates and breaks into the primer 50. Because of its instability, this causes the primer 50 to detonate thereby providing the necessary activation energy to detonate the propellant 40 and thereby detonating the propellant 40. Therefore, it can be seen through a chain of causation that the projection of the projectile assembly 10 causes the detonation of the primer 50 that causes the detonation of the propellant 40 that causes the inner member 30 to withdraw from the communicating portion 22 of the outer member 20 thereby causing separation between the first projectile 20 and the second projectile 30.

Figure 4:
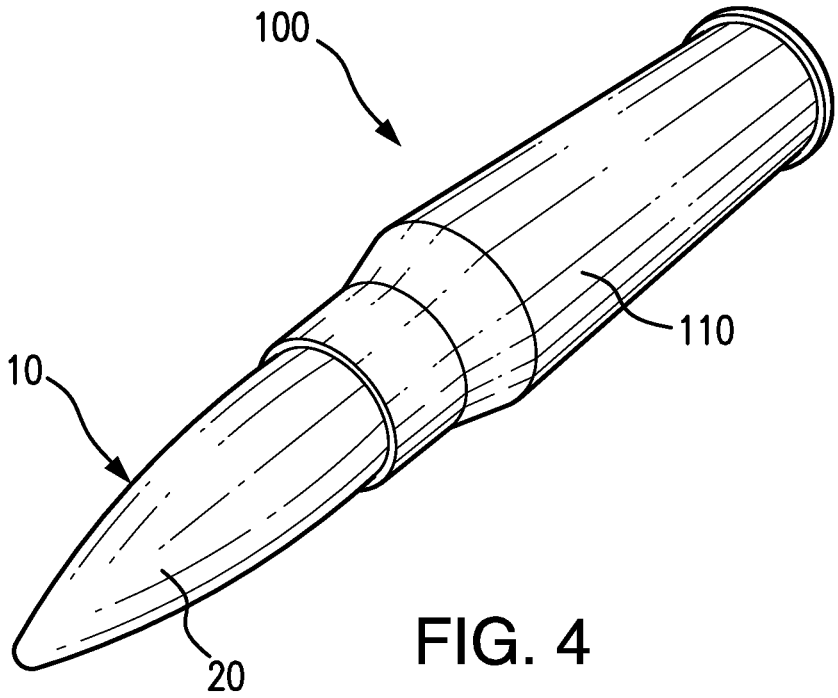
FIG. 4 is a schematic perspective view of a cartridge according to an embodiment, wherein the projectile assembly is shown as part of the cartridge, and the bullet case is shown as another part of the cartridge.

Additional reference is now made to FIG. 4. The multiple-purpose projectile assembly 10 is shown as part of a cartridge 100 in accordance with an embodiment. The cartridge 100 may include a case 110. The cartridge 100 is used for loading into a weapon; however after the weapon is fired, only the multiple-purpose projectile assembly 10 actually travels downrange. The remainder of the cartridge 100, including the case 110, may be ejected from the weapon, as is well known in the art, or handled in any other suitable manner. The cartridge 100 (not including the projectile assembly 10) may be of any cartridge type. The projectile assembly 10 may be loaded into a cartridge 100 without needing to modify the cartridge 100. In some embodiments, the cartridge 100 may have a diameter of 7.62 mm, herein referred to as a "7.62 mm cartridge" or a "7.62 mm round."

Figure 5:
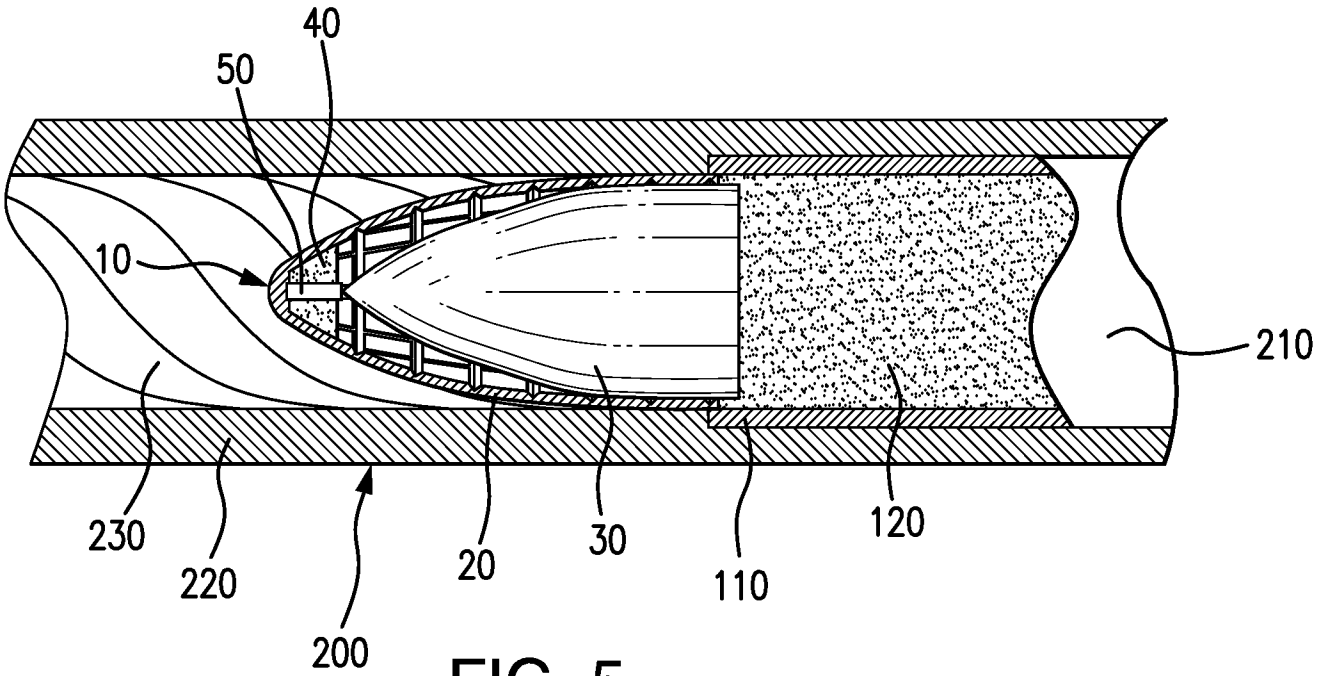
FIG. 5 is a schematic side sectional view of the multiple-purpose projectile assembly according to an embodiment, wherein the projectile assembly is shown as part of a cartridge that is loaded in the chamber of a firearm prior to firing.

Additional reference is now made to FIG. 5. The projectile assembly 10 is shown in elevational cross-section while loaded in a weapon 200. In accordance with an embodiment, the weapon 200 may include a chamber 210, a barrel 220, a bore 230, and a muzzle 240 (shown in FIG. 6). The cartridge 100 is loaded into the chamber 210 prior to projecting the projectile assembly 10. The powder 120 of the cartridge 100 is shown. This powder 120 is detonated at the time of firing to project the projectile assembly 10 forward through the bore 230 of the barrel 220. At the time of detonation of the powder 120, the projectile assembly 10 separates from the case 110. Particularly of note is that in some embodiments, the diameter of the widest portion of the outer member 20 of the projectile assembly 10 is the same as the diameter of the bore 230 of the weapon 200 in order to allow a maximum force buildup behind the projectile assembly 10 (in the rear of the bore 230 and in the chamber 210) in order to project the projectile assembly 10 forward at the highest speed possible. The weapon 200 may be of any weapon type. The weapon 200 may be configured to fire a cartridge 100 having the projectile assembly 10 without any need to modify the cartridge 100 or the weapon 200. The weapon 200 may have a bore 230 with a diameter of 7.62 mm, such a weapon 200 being herein referred to as a "7.62 mm weapon." 7.62 mm weapons are configured for firing 7.62 mm rounds.

Figure 6:
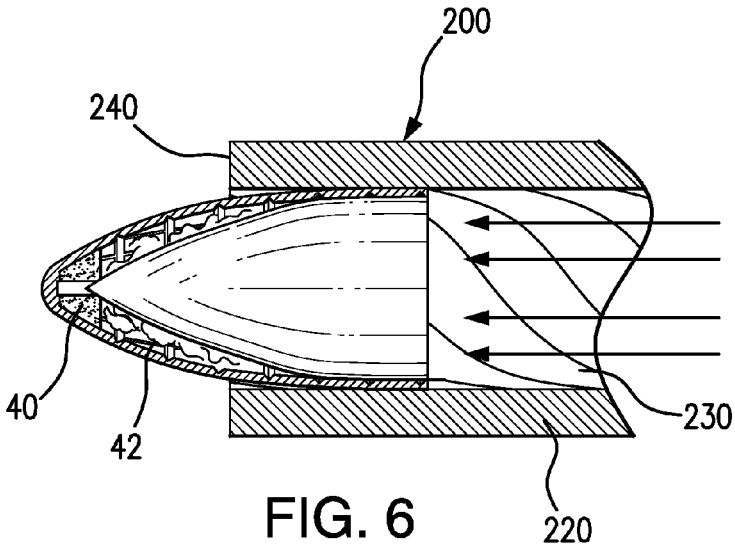
FIG. 6 is a schematic side sectional view of the multiple-purpose projectile assembly according to an embodiment, wherein the projectile assembly is shown traveling down the bore of a firearm, but has not yet completely passed through the muzzle of the firearm.

Additional reference is now made to FIG. 6. The projectile assembly 10 is shown in elevational cross-section after the weapon 200 has been fired, but before the projectile assembly 10 has left the bore 230. While the projectile assembly 10 is still completely or partially within the bore 230 (i.e. the entire projectile assembly 10 has not yet passed through the muzzle 240) the second projectile 30 is still forced against the first projectile 20 (i.e. they have not separated yet). This is because of the force due to pressure within the bore 230 behind the projectile assembly 10 as well as the force due to air resistance in front of the projectile assembly 10. These two forces keep the first projectile 20 and second projectile 30 "locked" together and prevent them from separating until the projectile assembly 10 actually leaves the bore 230 of the weapon 200. The forces on the projectile assembly 10 are strong enough such that they keep the two projectiles 20,30 locked together despite the pressure within the cavity 22 that is also increasing due to the detonation of the propellant 40 (which is applying a force to separate the two projectiles). In some embodiments, the propellant may define a "base bleed gas generator" in which the detonation of the propellant 40 at the time of firing causes the emission of a base bleed gas 42.

Figure 7:
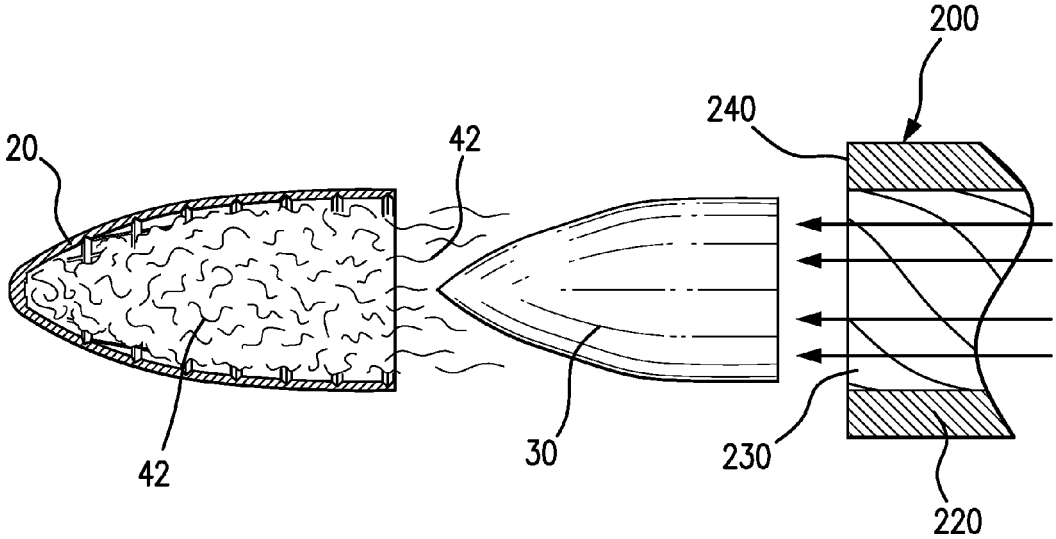
FIG. 7 is a schematic side sectional view of the multiple-purpose projectile assembly according to an embodiment, wherein the projectile assembly has entirely passed through the firearm muzzle and the second projectile has been ejected from the cavity of the first projectile, thereby releasing the base bleed gas from the cavity.

Additional reference is now made to FIG. 7. The projectile assembly 10 is shown in elevational cross section after it has left the bore 230 and has completely passed through the muzzle 240. After the projectile assembly 10 completely passes through the muzzle 240, the second projectile 30 experiences significantly less force from behind, since the pressure that had built up within the bore 230 is now capable of dispersing into the atmosphere. The base bleed gas 42 increases the pressure within the cavity 22 (thereby helping to "push" out the second projectile 30 once the projectile assembly 10 leaves the bore 230). The pressure build-up within the cavity 22 due to the detonation of the propellant 40 and the build-up of base bleed gas 42, the second projectile is ejected from the cavity 22 such that the first projectile 20 and the second projectile 30 separate. After the two projectiles have separated, the base bleed gas 42 pours out of the cavity 22 and fills in the area behind the first projectile 20. This area behind the first projectile 20 normally contributes significantly to the drag experienced by the first projectile 20, due to low pressure in the area and the tendency of the airflow surrounding the first projectile 20 to try and fill in that low pressure area. The base bleed gas 42 that is released into this low pressure area behind the first projectile 20 causes the area to increase in pressure, and therefore reduces the amount of drag that the first projectile 20 experiences. This may partially or completely offset the difference in drag experienced by the first projectile 20 and the second projectile 30 due to differences in shape and size. The base bleed gas 42 is therefore capable of increasing the range of the first projectile 20 by eliminating some of the drag experienced by the first projectile 20.

The first projectile 20 and the second projectile 30 travel along ballistic trajectories once fired. A ballistic trajectory is the path that a projectile takes after a propulsive force is terminated and the projectile is acted on by gravity and aerodynamic drag. In some embodiments, the ballistic trajectory of the second projectile 30 may be made similar or identical to the ballistic trajectory of the first projectile 20. In some embodiments, ballistic properties (properties having to do with the velocity or the ballistic trajectory of the projectile) of one or both projectile may be changed by changing one or more physical properties of one or more components of the multiple-purpose projectile assembly 10. More specifically, in some embodiments, ballistic properties of one or both projectiles may be changed by changing the diameter and/or the length and/or the weight of those projectiles. Additionally, in some embodiments, ballistic properties of one or both projectiles may be changed by changing the amount of the propellant 40 used and/or by changing the burn rate of the propellant 40.

EXAMPLES

An example of one embodiment will now be described. The scope of the attached claims is not limited to the example below.

Example 1

A dual-purpose projectile assembly capable of penetrating both hard and soft targets and that is capable of being fired from a 7.62 mm weapon having a barrel, a bore, a chamber, and a muzzle. The dual purpose projectile assembly includes an outer member, an inner member, a propellant, a base bleed gas, and a primer.

The outer member defines an anti-personnel projectile made from a soft metal such as lead and/or copper etc. The anti-personnel projectile has a wide diameter that contributes to expanding the projectile upon impact with a target. The anti-personnel projectile includes a cavity therein, the cavity having a scored surface having multiple scores. The scores increase the likelihood that the outer member will separate into multiple fragments upon impact with a target. Both the expansion of the outer member upon impact and the separation of the outer member into fragments upon impact specifically increase the capability of the projectile to cause damage to soft targets such as humans or animals, because expansion increases the area of the wound caused and increases the energy transfer to the target, while fragmentation splits the projectile into smaller, dispersing projectiles that may spread through a soft target and damage multiple portions of the target (e.g. damage multiple organs in a person). The anti-personnel projectile travels along a ballistic trajectory after being fired from a weapon that terminates at the point of impact with a target. This trajectory, and the speed at which the projectile travels along the trajectory, are both changeable in response to changes in the diameter and/or the length and/or the weight and/or the shape of the anti-personnel projectile.

The inner member defines an armor-penetrating projectile made from a hard metal such as steel, tungsten, depleted uranium, etc. The armor-penetrating projectile has a narrow diameter that contributes to preventing any deformation or expansion of the projectile upon impact with a target. Both the narrow shape and the hard metal material specifically increase the capability of the armor-penetrating projectile to penetrate hard targets such as tank armor or body armor. The anti-personnel projectile partially fills the cavity of the anti-personnel projectile prior to firing. The firing of the projectile assembly causes the simultaneous firing of the anti-personnel projectile and the armor-penetrating projectile, wherein the armor-penetrating projectile is fired along the same ballistic trajectory of the anti-personnel projectile (i.e. the armor-penetrating projectile will hit the exact same spot of the exact same target that the anti-personnel projectile hits). This trajectory, and the speed at which the armor-penetrating projectile travels along the trajectory, are both changeable in response to changes in the diameter and/or the length and/or the weight and/or the shape of the armor-penetrating projectile.

The propellant defines a base bleed gas generator and is capable of being detonated and is housed within the cavity of the outer member. The propellant is located between the outer member and the inner member. When the propellant is detonated, it increases the pressure of the cavity of the outer member. This increased pressure applies a force to the outer member (in the forward direction of the projectile assembly's trajectory) and a force to the inner member (in the opposite direction of the projectile assembly's trajectory). This causes the inner member to withdraw from the cavity of the outer member. This withdrawal can only occur after the projectile assembly has left the bore of the weapon, for when the projectile assembly is still within the bore, the pressure in the bore is so strong that it prevents the projectile assembly from separating into the two projectiles. The withdrawal defines an increased separation between the anti-personnel and the armor-penetrating projectiles. The detonation of the propellant causes the propellant to burn at a predetermined burn rate, wherein changing the amount of the propellant and/or the burn rate of the propellant may change the ballistic trajectories of one or both projectiles and/or the speed of one or both projectiles.

The base bleed gas is generated by the burning of the propellant. It is released into the cavity of the outer member after the propellant begins to burn, subsequently filling the cavity and expanding outwards from the cavity. The base bleed gas increases the pressure of any space that it fills. By increasing the pressure of the cavity and the space behind the anti-personnel projectile, it reduces the drag experienced by the anti-personnel projectile, offsetting the difference in drag experienced between both projectiles due to the armor-penetrating projectile being narrower (thus experiencing less drag). Thus, the base bleed gas may allow the anti-personnel projectile to be able to travel as far and as fast as the following armor-penetrating projectile.

The primer is capable of being detonated and is housed within the cavity of the outer member, adjacent to the propellant. The detonation of the primer is caused by the driving of the armor-penetrating projectile into the primer, because the primer is an extremely sensitive explosive that detonates on contact. The driving of the armor-penetrating projectile into the primer is caused by the firing of the projectile assembly. The detonation of the primer provides the necessary activation energy required by the propellant to detonate, therefore it detonates the propellant.

Throughout the detailed description and the accompanying drawings enclosed herein, some embodiments have been shown, described and detailed, wherein a variety of possible elements and/or features may be formed and configured in different ways. Accordingly, any and all possible combinations of the elements and/or features described in accordance with these various embodiments may be desirable to manufacturers and/or may help to more successfully meet customers' specific needs and/or preferences. Consequently, any and all possible combinations of the features or elements of one embodiment or more than one embodiment or all embodiments mentioned herein are fully considered within the spirit and scope of the attached claims and their legal equivalents.

Thus, some embodiments of a multiple-purpose projectile assembly for being projected have been disclosed. Other embodiments are contemplated and envisioned as well, and therefore it is recognized that departures from the embodiments described in this disclosure may certainly exist within the spirit and scope of the attached claims. Those having an ordinary skill in the art will envision other possible variations and modifications to features and/or elements of the embodiments, and they will envision other possible embodiments, all of which may fall within the spirit and scope of the attached claims. The spirit and scope of the attached claims is therefore not limited by the descriptions and illuminations of the embodiments that have already been presented, but rather the spirit and scope can only be defined by the attached claims and their legal equivalents as interpreted under the doctrine of equivalents. Variations, alternatives, adjustments, modifications, tunings, and deviations from the embodiments of the instant disclosure are fully contemplated and envisioned within the spirit and scope of the attached claims.

What is claimed is:

1. A multiple-purpose projectile assembly capable of being projected from a weapon comprising:

an outer member defining a first projectile, the outer member having an interior cavity defining a communicating portion;

an inner member defining a second projectile, the inner member being received and held within the communicating portion of the outer member prior to the projection of the projectile assembly;

a propellant within the interior cavity of the first projectile and located in a forward portion of the interior cavity between the first projectile and the second projectile and forward of the second projectile, and the propellant capable of being detonated to increase pressure within the interior cavity and apply a force to the first projectile in one direction and a simultaneous force to the second projectile in an opposite direction to cause separation of the first and second projectiles from one another after the projectile assembly has been projected from the weapon; and a primer located adjacent to the propellant within the forward portion of the interior cavity and forward of the second projectile, and the primer being structured to detonate upon the second projectile moving forward within the interior cavity and striking the primer when the projectile assembly is projected from the weapon, and wherein detonation of the primer causes detonation of the propellant.

2. The multiple-purpose projectile assembly as recited in claim 1 wherein the projection of the multiple-purpose projectile assembly causes both of the first projectile and the second projectile to travel along their own respective ballistic trajectories, and wherein the ballistic trajectory of the second projectile may be common to the ballistic trajectory of the first projectile for any projection of the multiple-purpose projectile assembly.

3. The multiple-purpose projectile assembly as recited in claim 2 wherein the ballistic trajectory of the second projectile may be identical to the ballistic trajectory of the first projectile for any projection.

4. The multiple-purpose projectile assembly as recited in claim 3 wherein one or more properties of one or more components of the multiple-purpose projectile assembly may be changed, and wherein the changes to the properties may change one or more ballistic properties of one or both of the first projectile and the second projectile.

5. The multiple-purpose projectile assembly as recited in claim 4 wherein one or more ballistic properties of at least one of the first projectile and the second projectile may be changed by the changing at least one of the diameter, the length, and the weight of at least one of the first projectile and the second projectile.

6. The multiple-purpose projectile assembly as recited in claim 5 wherein the outer member defines an anti-personnel projectile having a structure and being made from a material, wherein both of the structure and the material have properties that contribute to increasing the deformation of the outer member when the projected outer member impacts on a target.

7. The multiple-purpose projectile assembly as recited in claim 6 wherein the inner member defines an armor-penetrating projectile having a structure and being made from a material, wherein both of the structure and the material have properties that contribute to reducing the deformation of the inner member when the projected inner member impacts on the target, and wherein reducing the deformation of the inner member increases the capability of the armor-penetrating projectile to penetrate the target.

8. The multiple-purpose projectile assembly as recited in claim 7 wherein one or more of the multiple-purpose projectile assemblies may be loaded into one or more cartridges and subsequently projected from the weapon, and wherein the operations of both loading the projectile assembly into the cartridge and projecting the projectile assembly from the weapon do not require any modifications to the cartridge or the weapon.

9. The multiple-purpose projectile assembly as recited in claim 8 wherein the cartridge defines a 7.62 mm caliber cartridge and the weapon defines a 7.62 mm caliber weapon.

10. The multiple-purpose projectile assembly as recited in claim 8 wherein the propellant defines a base bleed gas generator capable of generating base bleed gas, and wherein the base bleed gas causes the first projectile to experience less drag while the first projectile is in motion.

11. The multiple-purpose projectile assembly as recited in claim 10 wherein the base bleed gas is capable of increasing the range of the first projectile.

12. The multiple-purpose projectile assembly as recited in claim 11 wherein one or more ballistic properties of one or both of the first projectile and the second projectile may be changed by changing of the amount of the propellant and/or by the changing of the burn rate of the propellant.

13. The multiple-purpose projectile assembly as recited in claim 12 wherein the cartridge defines a 7.62 mm caliber cartridge and the weapon defines a 7.62 mm caliber weapon.

14. A dual-purpose projectile assembly for penetrating both soft and hard targets, the projectile assembly capable of being fired from a weapon having at least a barrel, a bore, a chamber, and a muzzle, the projectile assembly comprising:

an outer member defining an anti-personnel projectile having a pre-determined structure, the outer member being made from a soft metal, both of the soft metal material and the structure of the outer member having properties that contribute to increasing the deformation of the outer member when the projected anti-personnel projectile impacts on a target, the increased deformation increasing the capability of the anti-personnel projectile to damage soft targets, and the outer member having an interior cavity therein, the cavity having a scored surface with a plurality of scores for increasing the likelihood that the outer member will separate into multiple fragments upon impact with a target, and the projection of the anti-personnel projectile from the weapon causing the anti-personnel projectile to travel along a ballistic trajectory;

an inner member defining an armor-penetrating projectile having a pre-determined structure, the inner member being made from a hard metal, both of the hard metal material and the structure of the inner member having properties that contribute to reducing the deformation of the inner member when the projected armor-penetrating projectile impacts on a target, the reduced deformation increasing the capability of the armor-penetrating projectile to penetrate hard targets, and the inner member being at least partially contained and held within the cavity of the outer member prior to projection;

a propellant capable of being detonated and housed within a forward portion of the cavity of the outer member and located between the outer member and the inner member and forward of the inner member the detonation of the propellant causing an increase in the pressure within the cavity of the outer member, the increased cavity pressure applying a force in the forward direction to the outer member and simultaneously applying a force in the opposite direction to the inner member, causing the inner member to withdraw from the cavity and separate from the outer member after the projectile assembly has left the bore of the weapon; and a primer that is capable of being detonated by impact, the primer housed within the forward portion of cavity of the outer member and forward of the inner member and located adjacent to the propellant, the detonation the primer being caused by the forward projecting of the inner member relative to the outer member and the inner member impacting the primer, and the detonation of the primer causing the detonation of the propellant.

15. The dual-purpose projectile assembly as recited in claim 14, wherein one or more of the dual-purpose projectile assemblies is capable of being loaded into a weapon cartridge and subsequently projected from the weapon.

16. The dual purpose projectile assembly as recited in claim 15, wherein the cartridge is a 7.62 mm caliber cartridge and the weapon is a 7.62 mm caliber weapon.

17. A multiple-purpose projectile assembly capable of being projected from a weapon comprising:

a first projectile having an interior cavity with a forward portion therein;

a second projectile received and held at least partially within the interior cavity of the first projectile prior to the projection of the projectile assembly from the weapon;

a propellant within the interior cavity of the first projectile and located in a forward portion of the interior cavity between the first projectile and the second projectile and forward of the second projectile, and the propellant capable of being detonated to increase pressure within the interior cavity and apply a force to the first projectile in one direction and a simultaneous force to the second projectile in an opposite direction to cause separation of the first and second projectiles from one another after the projectile assembly has been projected from the weapon; and a primer located adjacent to the propellant within the forward portion of the interior cavity and forward of the second projectile, and the primer being structured to detonate upon the second projectile moving forward within the interior cavity and striking the primer when the projectile assembly is projected from the weapon, and wherein detonation of the primer causes detonation of the propellant.

18. The multi-purpose projectile assembly as recited in claim 17 wherein the propellant is structured and disposed for generating a bleed gas that is released during detonation of the propellant, the base bleed gas increasing pressure in a space directly behind the first and second projectiles when the projectile assembly has been projected from the weapon to reduce drag forces on the first and second projectiles during projection thereof.

* * * * *